US006707439B2

(12) United States Patent
Ijima et al.

(10) Patent No.: US 6,707,439 B2
(45) Date of Patent: Mar. 16, 2004

(54) LIQUID CRYSTAL DISPLAY

(75) Inventors: Yukio Ijima, Kumamoto (JP); Seiki Takahashi, Kumamoto (JP); Shiro Miyake, Kumamoto (JP)

(73) Assignee: Kabushiki Kaisha Advanced Display, Kumamoto (JP)

( * ) Notice: Subject to any disclaimer, the term of this patent is extended or adjusted under 35 U.S.C. 154(b) by 300 days.

(21) Appl. No.: 09/962,809

(22) Filed: Sep. 26, 2001

(65) Prior Publication Data

US 2002/0044151 A1 Apr. 18, 2002

(30) Foreign Application Priority Data

Sep. 28, 2000 (JP) ..... 2000-296999

(51) Int. Cl.[7] ..... G09G 3/36

(52) U.S. Cl. ..... 345/87; 345/98; 345/99; 345/101

(58) Field of Search ..... 345/87, 88, 89, 345/98, 99, 100, 101, 102, 207, 211, 212, 213, 690, 691, 3.2, 3.1, 3.4, 698; 348/790, 792, 793

(56) References Cited

U.S. PATENT DOCUMENTS 5,689,311 A * 11/1997 Lee ..... 348/674
5,953,002 A * 9/1999 Hirai et al. ..... 345/204
6,181,300 B1 * 1/2001 Poon et al. ..... 345/698
6,388,648 B1 * 5/2002 Clifton et al. ..... 345/88
6,456,340 B1 * 9/2002 Margulis ..... 348/745
6,611,249 B1 * 8/2003 Evanicky et al. ..... 345/102
2003/0001810 A1 * 1/2003 Yamaguchi et al. ..... 345/87

FOREIGN PATENT DOCUMENTS

| | | |
|---|---|---|
| JP | 4318516 | 11/1992 |
| JP | 5-6150 | 1/1993 |
| JP | 6-46357 | 2/1994 |
| JP | 7-56532 | 3/1995 |

* cited by examiner

*Primary Examiner*—Xiao Wu
(74) *Attorney, Agent, or Firm*—McDermott, Will & Emery

(57) ABSTRACT

In the conventional method of achieving a fast response of a liquid crystal panel, even if the frame rate or the ambient temperature varies, if the image data are the same, the correction value will always be constant; accordingly, the conventional method is impossible of a correction in accordance with the environmental conditions in use. The liquid crystal display of the invention is provided with a plurality of look-up tables, each of which outputs a correction data for correcting an image data to increase the response speed of transmittance of the liquid crystal panel by using the two inputs of the input image data and the image data one frame before that an image memory storing the input image data outputs. The liquid crystal display selects one of the look-up tables in accordance with a frame rate that a frame rate detection circuit detects from the input image data, generates the correction data, and drives the liquid crystal panel using this correction data; thereby, the method of the invention increases the response speed in a change of the gradation.

7 Claims, 4 Drawing Sheets

PRIOR ART

LIQUID CRYSTAL DISPLAY

BACKGROUND OF THE INVENTION

1. Field of the Invention

The present invention relates to a liquid crystal display that achieves a fast response of a liquid crystal panel.

2. Related Art

FIG. 4 is a block diagram of a circuit that executes the correction for a fast response of a conventional liquid crystal display.

In FIG. 4, 1 signifies an image memory that stores input image data, 2 a synchronization control circuit that receives the image data, and delivers the image data and a synchronization control signal, 3 a look-up table formed on a ROM, which stores correction data in correspondence with the inputs of current image data outputted from the synchronization control circuit 2 and previous image data outputted from the image memory 1. 4 signifies a source-line drive circuit that outputs a drive signal based on the output from the look-up table 3 and the control signal from the synchronization control circuit 2 to source lines, 5 a gate-line drive circuit that outputs a drive signal based on the control signal outputted from the synchronization control circuit 2 to gate lines. 6 signifies a liquid crystal panel that forms a display in accordance with the image data, by the output from the gate-line drive circuit 5 and the output from the source-line drive circuit 4.

The conventional method of achieving a fast response of a liquid crystal panel includes storing the input digital image data for one frame in the image memory 1, storing the correction data determined by the two inputs of the input digital image data and the image data with one frame delayed, read from the image memory 1, in the look-up table 3, converting the image data into emphasized correction data by the look-up table 3, and driving the liquid crystal panel 6 by using this correction data, thereby enhancing the response speed of a transmittance change, namely, gradation change of the liquid crystal panel 6.

The conventional method of achieving a fast response of a liquid crystal panel executes a data conversion by the look-up table 3, on the basis of the two input data of current and previous image data, and thereby enhances the response speed. However, this conventional method only executes the correction by the image data; and even if the frame rate or the ambient temperature varies, if the image data are the same, the correction value will always be constant. Therefore, the conventional method is impossible of a correction in accordance with the environmental conditions in use (frame rate, ambient temperature, etc.).

The invention has been made in view of the foregoing circumstances, and it is an object of the invention to provide a liquid crystal display that enables a correction in response to the environmental conditions in use, and enhances a response speed of a liquid crystal panel.

SUMMARY OF THE INVENTION

According to one aspect of the invention, a liquid crystal display includes: a frame rate detection unit that detects a frame rate of a current image data; a correction data generation unit receiving the current image data and a previous image data inputted one frame before, having a plurality of look-up tables, each of which is configured in such a manner that when the current image data is greater than the previous image data, it outputs a correction data greater than the current image data, and when the current image data is smaller than the previous image data, it outputs a correction data smaller than the current image data; and a drive circuit that drives a liquid crystal panel with an output from the correction data generation unit. In this construction, one of the plural look-up tables of the correction data generation unit is selected in accordance with the frame rate of the current image data detected by the frame rate detection unit.

According to another aspect of the invention, a liquid crystal display includes: a frame rate conversion unit that converts a frame rate of a current image data into a specific frame rate to output it as a converted image data; a correction data generation unit receiving the converted image data outputted from the frame rate conversion unit and a previous converted image data inputted one frame before, which is configured in such a manner that when the converted image data is greater than the previous converted image data, it outputs a correction data greater than the converted image data, and when the converted image data is smaller than the previous converted image data, it outputs a correction data smaller than the converted image data; and a drive circuit that drives a liquid crystal panel with an output from the correction data generation unit.

According to another aspect of the invention, a liquid crystal display includes: an ambient temperature detection unit that detects an ambient temperature; a frame rate conversion unit that converts a frame rate of a current image data into a frame rate corresponding to the ambient temperature detected by the ambient temperature detection unit to output it as a converted image data; a correction data generation unit receiving the converted image data outputted from the frame rate conversion unit and a previous converted image data inputted one frame before, which is configured in such a manner that when the converted image data is greater than the previous converted image data, it outputs a correction data greater than the converted image data, and when the converted image data is smaller than the previous converted image data, it outputs a correction data smaller than the converted image data; and a drive circuit that drives a liquid crystal panel with an output from the correction data generation unit.

According to another aspect of the invention, the liquid crystal display further includes: a synchronization control circuit receiving the current image data, outputting a control signal to the drive circuit; and an image memory controlled by the synchronization control circuit, storing the current image data, in which the previous image data one frame before is outputted from the image memory.

According to another aspect of the invention, the liquid crystal display further includes: a synchronization control circuit receiving the converted image data, outputting a control signal to the drive circuit; and an image memory controlled by the synchronization control circuit, storing the converted image data, in which the previous converted image data one frame before is outputted from the image memory.

And, preferably, the correction data generation unit is formed on a non-volatile semiconductor memory.

The invention being thus constructed, its displays the following effects.

The liquid crystal display of the invention is provided with: a frame rate detection unit that detects a frame rate of a current image data; a correction data generation unit receiving the current image data and a previous image data inputted one frame before, having a plurality of look-up tables, each of which is configured in such a manner that when the current image data is greater than the previous image data, it outputs a correction data greater than the current image data, and when the current image data is smaller than the previous image data, it outputs a correction data smaller than the current image data; and a drive circuit that drives a liquid crystal panel with an output from the correction data generation unit, in which one of the plural look-up tables of the correction data generation unit is selected in accordance with the frame rate of the current image data detected by the frame rate detection unit. Thereby, the invention executes a correction in accordance with the frame rate of the current image data, and achieves a fast response in a change of the gradation.

Further, the liquid crystal display of the invention is provided with: a frame rate conversion unit that converts a frame rate of a current image data into a specific frame rate to output it as a converted image data; a correction data generation unit receiving the converted image data outputted from the frame rate conversion unit and a previous converted image data inputted one frame before, which is configured in such a manner that when the converted image data is greater than the previous converted image data, it outputs a correction data greater than the converted image data, and when the converted image data is smaller than the previous converted image data, it outputs a correction data smaller than the converted image data; and a drive circuit that drives a liquid crystal panel with an output from the correction data generation unit. Thereby, the invention attains a suitable correction even in a change of the frame rate of the current image data, and achieves a fast response in a change of the gradation.

Further, the liquid crystal display of the invention is provided with: an ambient temperature detection unit that detects an ambient temperature; a frame rate conversion unit that converts a frame rate of a current image data into a frame rate corresponding to the ambient temperature detected by the ambient temperature detection unit to output it as a converted image data; a correction data generation unit receiving the converted image data outputted from the frame rate conversion unit and a previous converted image data inputted one frame before, which is configured in such a manner that when the converted image data is greater than the previous converted image data, it outputs a correction data greater than the converted image data, and when the converted image data is smaller than the previous converted image data, it outputs a correction data smaller than the converted image data; and a drive circuit that drives a liquid crystal panel with an output from the correction data generation unit. Thereby, the invention executes a correction in accordance with the ambient temperature, and achieves a fast response in a change of the gradation.

Further, the liquid crystal display of the invention is further provided with: a synchronization control circuit receiving the current image data, outputting a control signal to the drive circuit; and an image memory controlled by the synchronization control circuit, storing the current image data, in which the previous image data one frame before is outputted from the image memory, whereby the previous image data can be formed.

Further, the liquid crystal display of the invention is further provided with: a synchronization control circuit receiving the converted image data, outputting a control signal to the drive circuit; and an image memory controlled by the synchronization control circuit, storing the converted image data, in which the previous converted image data one frame before is outputted from the image memory, whereby the previous converted image data can be formed.

Further, since the correction data generation unit is formed on a non-volatile semiconductor memory, the circuit size can be reduced.

BRIEF DESCRIPTION OF THE DRAWINGS

Preferred embodiments of the present invention will be described in detail based on the followings, wherein.

DETAILED DESCRIPTION OF PREFERRED EMBODIMENTS

Embodiment 1

Figure 1:
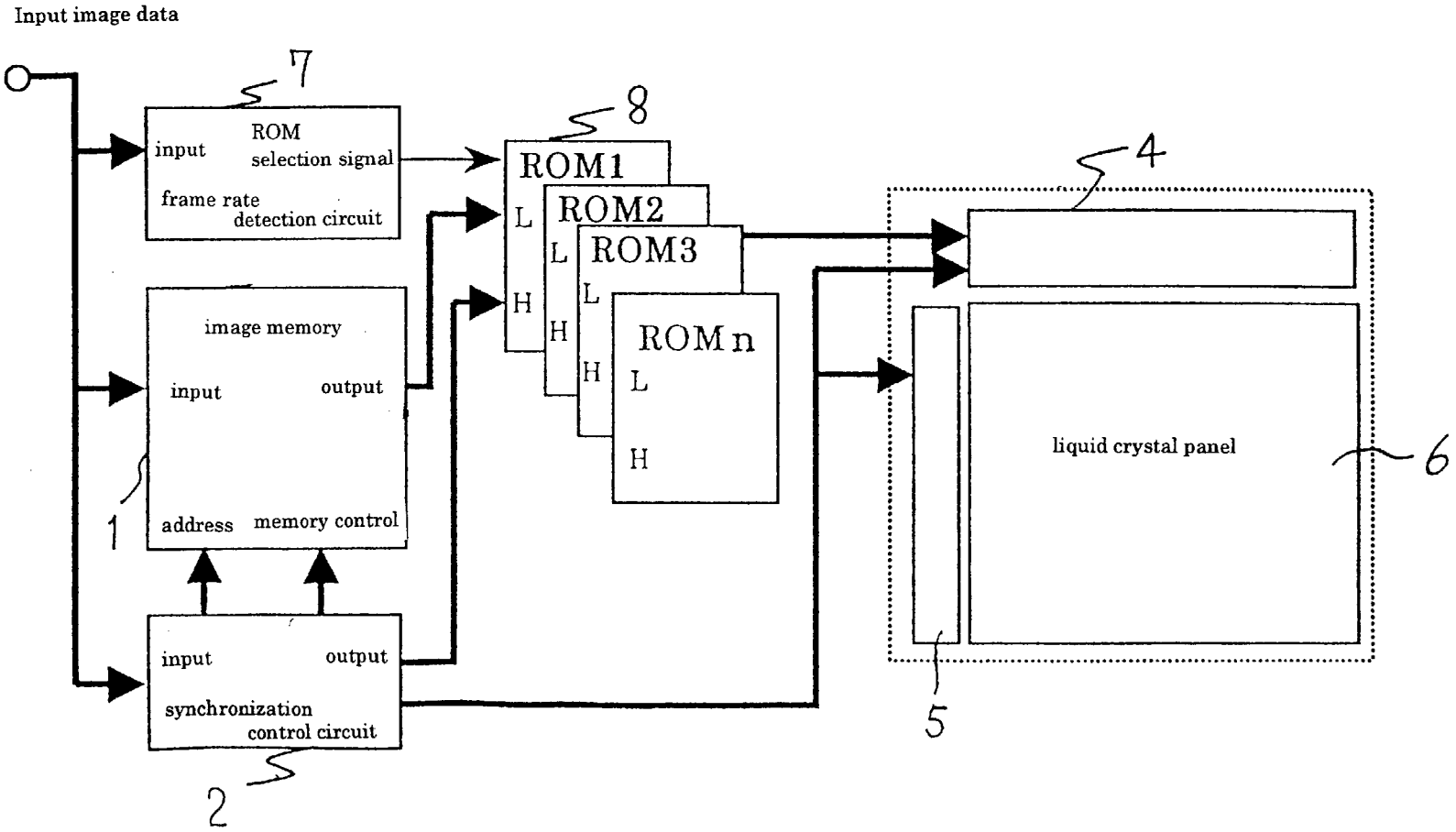
FIG. 1 is a block diagram illustrating a circuit configuration that executes a correction for a fast response in a change of the frame rate of the liquid crystal display according to the embodiment 1.

FIG. 1 is a block diagram illustrating a circuit configuration that executes a correction for a fast response in a change of the frame rate of the liquid crystal display according to the embodiment 1.

In FIG. 1, 1 denotes an image memory that stores input image data, and 2 a synchronization control circuit that inputs the image data, and outputs the image data and a synchronization control signal. 4 denotes a source-line drive circuit that outputs a drive signal to source lines on the basis of the control signal outputted from the synchronization control circuit 2, 5 a gate-line drive circuit that outputs a drive signal to gate lines on the basis of the control signal outputted from the synchronization control circuit 2. 6 denotes a liquid crystal panel that forms a display in accordance with the image data, by the output from the gate-line drive circuit 5 and the output from the source-line drive circuit 4. 7 denotes a frame rate detection circuit (frame rate detection unit) that detects a frame rate of the input image data, 8 a plurality of look-up tables (correction data generation unit) one of which is selected for use in correspondence with the frame rate of the image data, and each of the look-up tables stores correction data in accordance with the inputs of the current image data outputted from the synchronization control circuit 2 and the previous image data outputted from the image memory 1, which is formed on a ROM (non-volatile semiconductor memory). Each of the look-up tables is configured such that it receives the current image data and the previous image data inputted one frame before; and if the current image data is greater than the previous image data, it outputs a correction data greater than the current image data, and if the current image data is smaller than the previous image data, it outputs a correction data smaller than the current image data.

Next, the operation will be described.

As shown in FIG. 1, the embodiment 1 includes the frame rate detection circuit 7 and a plurality of the look-up tables 8. The frame rate detection circuit 7 generates a signal to select the look-up table 8 that stores the correction data suitable for the input image data from the frame rate (HD, VD) of the image data. The look-up table 8 possesses plural memories for the specification of the frame rate of the input image data. The image memory 1, being capable of storing the image data for one frame, operates to follow the memory address and write command given by the synchronization control circuit 2, sequentially stores the image data, and sequentially outputs the data one frame later to the input terminal of the look-up table 8.

The look-up table 8 being selected by the output of the frame rate detection circuit 7 receives the input digital image data and the one-frame delayed image data (previous image data) read from the image memory 1, and delivers the optimum correction value being stored in advance on the basis of the two input data received. The image data outputted from the look-up table 8 is the one having the degree of change of the data emphasized in order to make the transmittance of the liquid crystal panel respond in a high speed. As the result, the response speed of the liquid crystal panel 6 can be enhanced, and it becomes possible to make the liquid crystal panel follow quickly in response to a change of the frame rate.

According to the embodiment 1, when the frame rate is changed, the look-up table 8 is selected from the two input data of the current and previous image data to be suitable for the data, the optimum correction value stored in advance in the look-up table 8 selected is read out, and an emphasized image data is attained, which enhances the response speed of the liquid crystal panel, and it becomes possible to make the liquid crystal panel follow quickly in response to a change of the frame rate.

Embodiment 2

Figure 2:
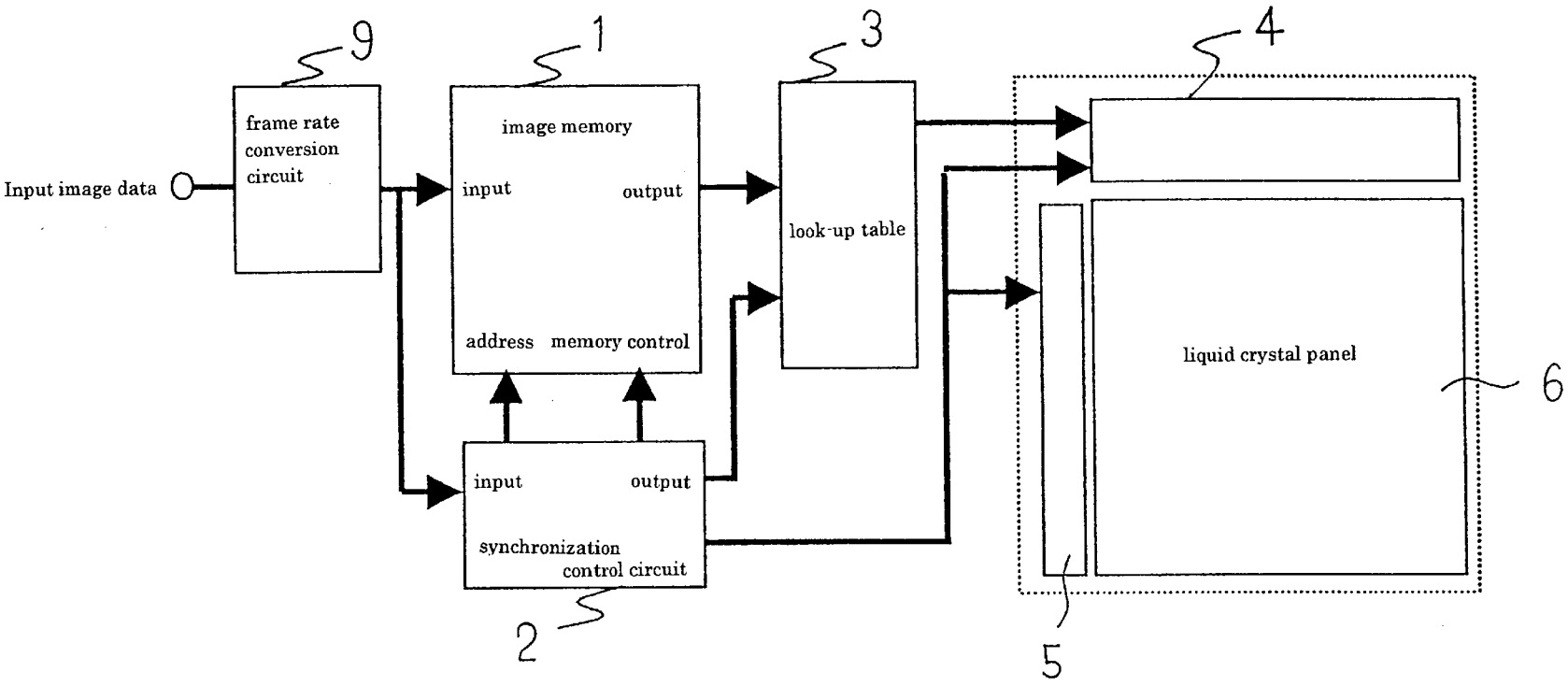
FIG. 2 is a block diagram illustrating a circuit configuration that executes a correction for a fast response in a change of the frame rate of the liquid crystal display according to the embodiment 2.

FIG. 2 is a block diagram illustrating a circuit configuration that executes a correction for a fast response in a change of the frame rate of the liquid crystal display according to the embodiment 2.

In FIG. 2, 1 denotes an image memory that stores image data (converted image data) of which frame rate is converted by a frame rate conversion circuit described later, and outputs image data (previous converted image data) having one frame delayed, 2 a synchronization control circuit that inputs the image data (converted image data) of which frame rate is converted by the frame rate conversion circuit, and outputs the image data and a synchronization control signal, 3 a look-up table formed on a ROM, which stores correction data in correspondence with the inputs of current image data (converted image data) outputted from the synchronization control circuit 2 and previous image data (previous converted image data) outputted from the image memory 1. 4 denotes a source-line drive circuit that outputs a drive signal to source lines on the basis of the output from the look-up table 3 and the control signal outputted from the synchronization control circuit 2, and 5 a gate-line drive circuit that outputs a drive signal to gate lines on the basis of the control signal outputted from the synchronization control circuit 2. 6 denotes a liquid crystal panel that forms a display in accordance with the image data, by the output from the gate-line drive circuit 5 and the output from the source-line drive circuit 4. 9 denotes a frame rate conversion circuit (frame rate conversion unit) that converts a frame rate of the current input image data into a specific frame rate of the image data (converted image data).

Next, the operation will be described.

As shown in FIG. 2, the embodiment 2 is furnished with the frame rate conversion circuit 9 on the input of the digital image data. The frame rate conversion circuit 9 converts the frame rate of the current image data into a constant frame rate, in response to a change of the frame rate (HD, VD); and, in consequence, the correction is to be executed referring to the look-up table 3 that stores one correction data. Thus, the response speed of the liquid crystal panel can be enhanced, and it becomes possible to make the liquid crystal panel follow quickly in response to a change of the frame rate.

According to the embodiment 2, although the frame rate changes, the output becomes always constant, and the correction can be executed with one look-up table. The embodiment 2 only needs one look-up table, thereby reducing the circuit scale.

Embodiment 3

Figure 3:
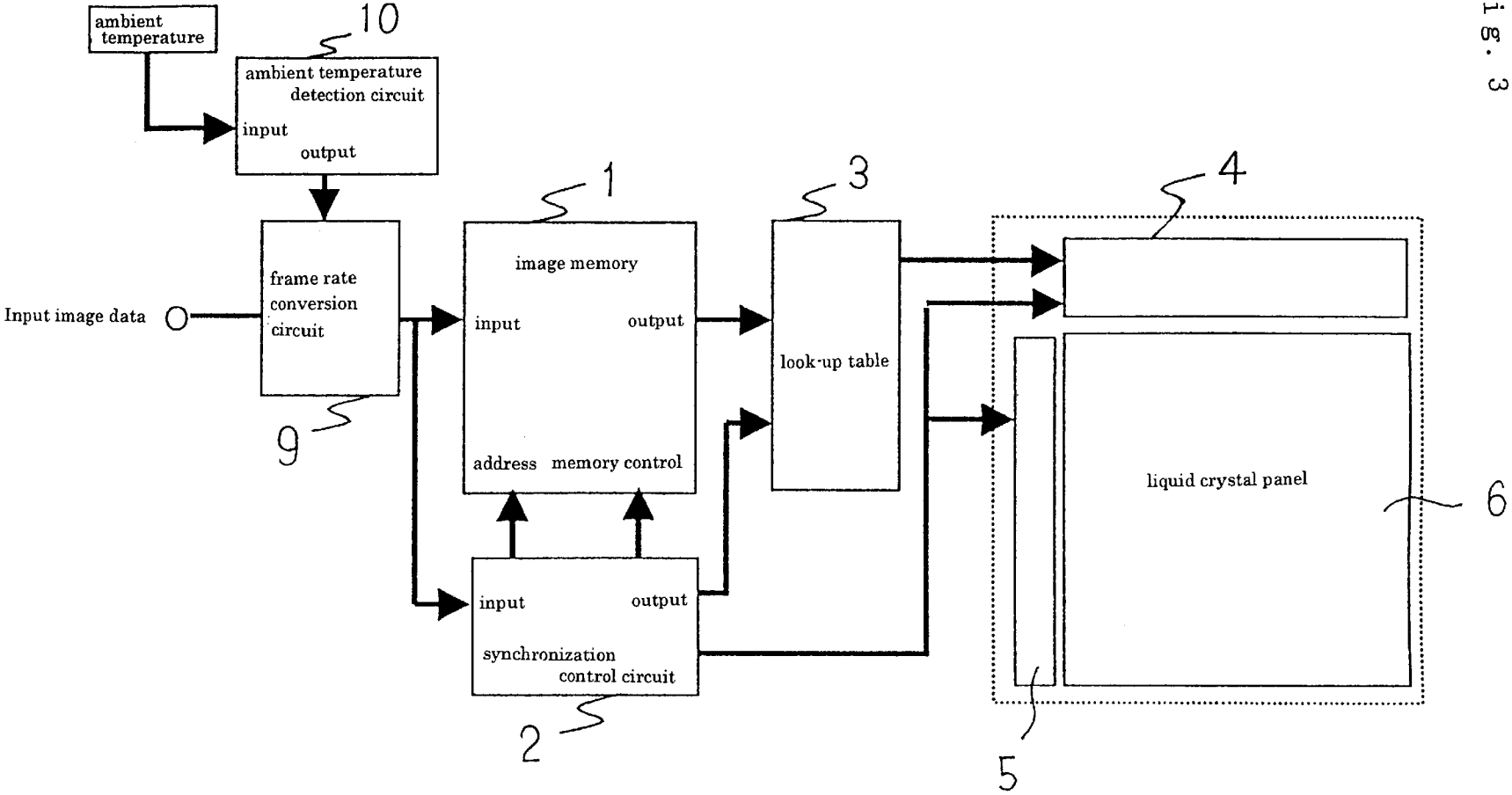
FIG. 3 is a block diagram illustrating a circuit configuration that executes a correction for a fast response in a change of the ambient temperature of the liquid crystal display according to the embodiment 3.
Figure 4:
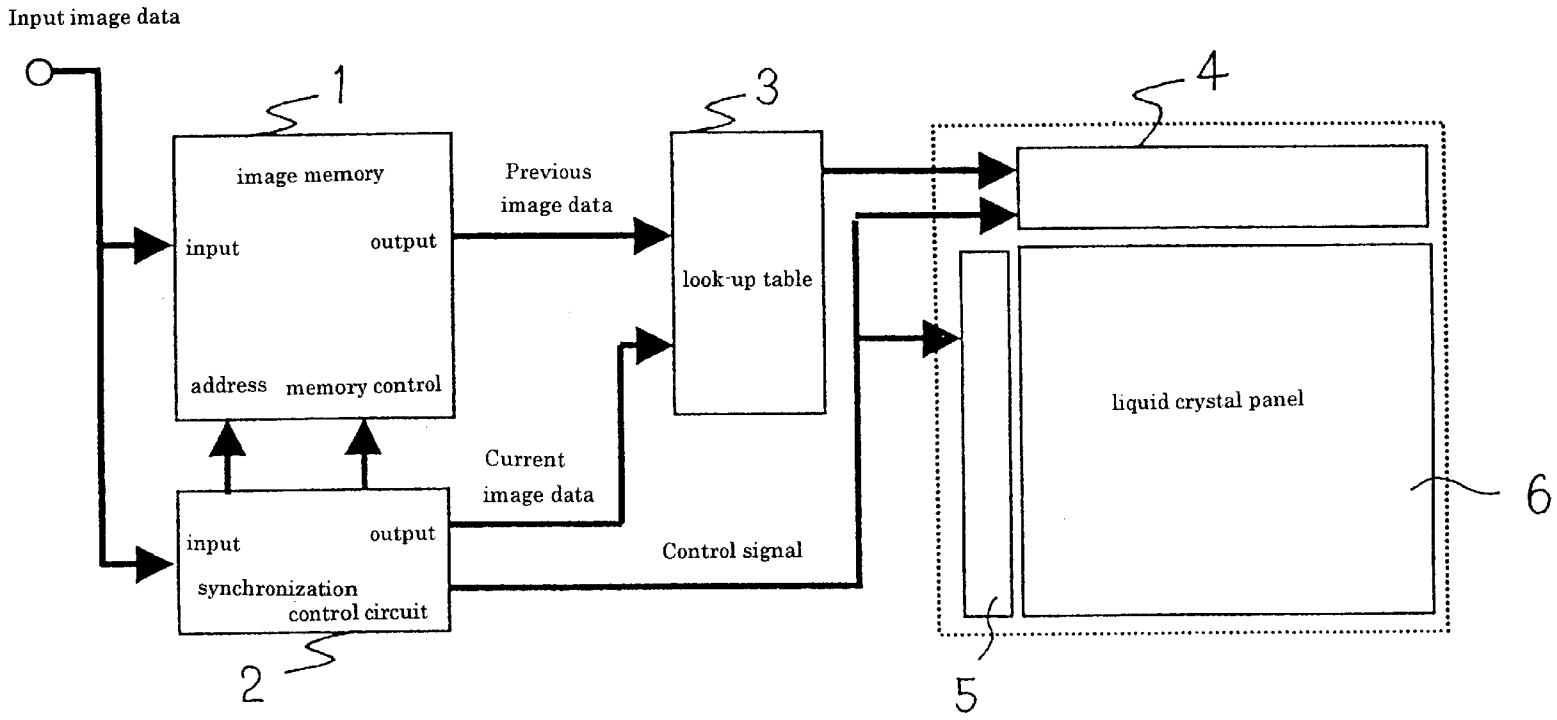
FIG. 4 is a block diagram illustrating a circuit configuration that executes the correction for a fast response of a conventional liquid crystal display.

FIG. 3 is a block diagram illustrating a circuit configuration that executes a correction for a fast response in a change of the ambient temperature of the liquid crystal display according to the embodiment 3.

In FIG. 3, 1~6, 9 represent the same as those in FIG. 2, and the explanation thereof will be omitted. 10 represents an ambient temperature detection circuit (ambient temperature detection unit) that detects an ambient temperature.

As shown in FIG. 3, the embodiment 3 is furnished with the ambient temperature detection circuit 10 on the preceding stage of the frame rate conversion circuit 9. The ambient temperature detection circuit 10 detects an ambient temperature in order to compensate the response time of the liquid crystal panel that varies depending on the influence of the ambient temperature, and generates a signal to determine a frame rate. The frame rate conversion circuit 9 determines a frame rate in accordance with an ambient temperature, and changes the frame rate being the applied time to the liquid crystal panel. As the result, the temperature compensation can be implemented, and it becomes possible to make the transmittance of the liquid crystal follow quickly in response to a change of the ambient temperature.

According to the embodiment 3, when there is a change in the ambient temperature, the ambient temperature detection circuit detects an ambient temperature, determines a frame rate by the temperature, and varies the frame rate being the applied time to the liquid crystal panel in accordance with the ambient temperature, thereby implementing the temperature compensation.

What is claimed is:

1. A liquid crystal display comprising:

a frame rate detection unit that detects a frame rate of a current image data;

a correction data generation unit receiving the current image data and a previous image data inputted one frame before, having a plurality of look-up tables, each of which is configured in such a manner that when the current image data is greater than the previous image data, it outputs a correction data greater than the current image data, and when the current image data is smaller than the previous image data, it outputs a correction data smaller than the current image data; and a drive circuit that drives a liquid crystal panel with an output from the correction data generation unit, wherein one of the plural look-up tables of the correction data generation unit is selected in accordance with the frame rate of the current image data detected by the frame rate detection unit.

2. A liquid crystal display as claimed in claim 1, further comprising:

a synchronization control circuit receiving the current image data, outputting a control signal to the drive circuit; and an image memory controlled by the synchronization control circuit, storing the current image data, wherein the previous image data one frame before is outputted from the image memory.

3. A liquid crystal display as claimed in claim 1, wherein the correction data generation unit is formed on a non-volatile semiconductor memory.

4. A liquid crystal display comprising:

a frame rate conversion unit that converts a frame rate of a current image data into a specific frame rate to output it as a converted image data;

a correction data generation unit receiving the converted image data outputted from the frame rate conversion unit and a previous converted image data inputted one frame before, which is configured in such a manner that when the converted image data is greater than the previous converted image data, it outputs a correction data greater than the converted image data, and when the converted image data is smaller than the previous converted image data, it outputs a correction data smaller than the converted image data; and a drive circuit that drives a liquid crystal panel with an output from the correction data generation unit.

5. A liquid crystal display as claimed in claim 2, further comprising:

a synchronization control circuit receiving the converted image data, outputting a control signal to the drive circuit; and an image memory controlled by the synchronization control circuit, storing the converted image data, wherein the previous converted image data one frame before is outputted from the image memory.

6. A liquid crystal display comprising:

an ambient temperature detection unit that detects an ambient temperature;

a frame rate conversion unit that converts a frame rate of a current image data into a frame rate corresponding to the ambient temperature detected by the ambient temperature detection unit to output it as a converted image data;

a correction data generation unit receiving the converted image data outputted from the frame rate conversion unit and a previous converted image data inputted one frame before, which is configured in such a manner that when the converted image data is greater than the previous converted image data, it outputs a correction data greater than the converted image data, and when the converted image data is smaller than the previous converted image data, it outputs a correction data smaller than the converted image data; and a drive circuit that drives a liquid crystal panel with an output from the correction data generation unit.

7. A liquid crystal display as claimed in claim 6, further comprising:

a synchronization control circuit receiving the converted image data, outputting a control signal to the drive circuit; and an image memory controlled by the synchronization control circuit, storing the converted image data, wherein the previous converted image data one frame before is outputted from the image memory.

* * * * *